United States Patent [19]

Humphries

[11] Patent Number: 4,901,703

[45] Date of Patent: Feb. 20, 1990

[54] CRANKCASE VENTILATION SYSTEM FOR A RECIPROCATING INTERNAL COMBUSTION ENGINE

[75] Inventor: David T. Humphries, Hove, England

[73] Assignee: Rolls-Royce Motor Cars Limited, Crewe, England

[21] Appl. No.: 195,357

[22] Filed: May 16, 1988

Related U.S. Application Data

[63] Continuation-in-part of Ser. No. 920,551, Oct. 20, 1986, abandoned.

[30] Foreign Application Priority Data

Oct. 19, 1985 [GB] United Kingdom ..... 8525835

[51] Int. Cl.[4] ..... F02M 25/06

[52] U.S. Cl. ..... 123/572; 123/559.1

[58] Field of Search ..... 123/572, 574, 98 P, 123/41.86, 559, 559.1

[56] References Cited

U.S. PATENT DOCUMENTS

| | | | |
|---|---|---|---|
| 2,463,828 | 3/1949 | Trisler | 123/559 |
| 3,175,546 | 3/1965 | Roper | 123/572 |

FOREIGN PATENT DOCUMENTS

| | | | |
|---|---|---|---|
| 3604090 | 2/1987 | Fed. Rep. of Germany . | |
| 2283315 | 3/1976 | France . | |
| 0027016 | 3/1981 | Japan | 123/572 |
| 0126412 | 7/1983 | Japan | 123/41.86 |
| 60-81416 | 9/1985 | Japan . | |

*Primary Examiner*—Willis R. Wolfe
*Assistant Examiner*—M. Macy
*Attorney, Agent, or Firm*—Cushman, Darby & Cushman

[57] ABSTRACT

In a reciprocating internal combustion engine, which may be turbocharged or normally aspirated, the inlet manifold is connected by a duct 10 to a bypass 9 which in turn connects the crankcase 8 to a point upstream of the throttle. Non-return valves 11 and 12 are disposed in the duct 10 and bypass 9 respectively. An adjustable diaphragm valve 14, whose operation is controlled by the pressure in a pressure sensor line 15 leading to crankcase 8, is disposed in a bypass 13 to the valve 12. The arrangement operates to prevent crankcase overpressure under normal operating conditions of the engine.

9 Claims, 5 Drawing Sheets

CRANKCASE VENTILATION SYSTEM FOR A RECIPROCATING INTERNAL COMBUSTION ENGINE

Figure 1:
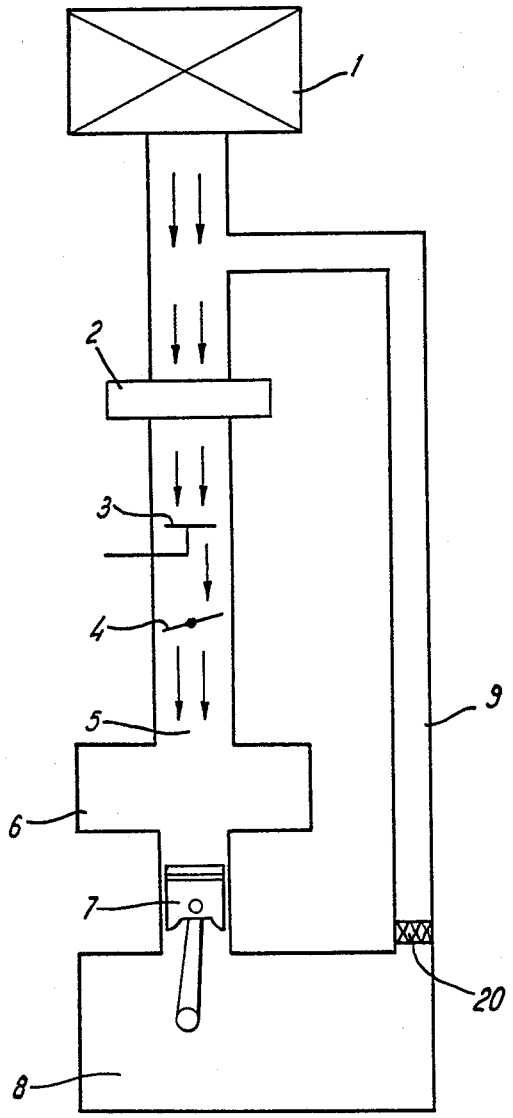
FIG. 1 PRIOR ART

This application is a continuation-in-part application of Ser. No. 920,551 filed Oct. 20, 1986, and now abandoned.

This invention relates to means for ventilating a crankcase of an internal combustion engine so as to maintain the crankcase pressure within certain prespecified limits. The invention is particularly applicable to turbo-charged engines.

The associated problems of blow-by gases within the crankcase of normally aspirated engines have long been known. Prior art on this subject, such as, U.S. Pat. No. 3,175,546 to Roper and U.S. Pat. No. 2,463,828 to Trisler provides a method of venting the crankcase of normally aspirated engines via a flow by blow-by gas from the crankcase to the inlet via a flow of blow-by gas from the crankcase to the inlet manifold, the rate of flow of gas depending on the pressure of the inlet manifold rather than that of the crankcase. The prior art also fails to deal with the added associated problems on insertion of a turbocharger into this system.

It is an object of the invention to overcome these problems, previously not referred to in the prior art, by monitoring the crankcase pressure at source rather than by monitoring inlet manifold pressure, and relating this to the crankcase pressure. In this way the invention enables the crankcase pressure of the engine to be confined within pre-specified limits.

It is a further object of this invention to overcome the problem of insertion of a turbo-charger into the system. There is a particular desire to maintain a sub-atmospheric crankcase pressure in the case of turbocharged engines if efficient operation of the engine is to be achieved and the undesirable emission of blue smoke, due to leakage of engine oil into the exhaust system, is to be avoided. At low engine speeds there exists a negative pressure across the air filter of the engine. Due to the build up of blow-by gas, there also exists a positive pressure with respect to atmospheric pressure in the crankcase.

Now there is a need to lubricate the bearings of the turbo-compressor in a turbocharged engine with oil, which is subsequently drained to the crankcase.

Due to the previously referred to negative pressure across the air filter and positive pressure in the crankcase, oil may be forced across the oil seals within the turbo-compressor. This results in leakage of oil into the inlet manifold which is subsequently ejected via the exhaust pipe in the form of an undesirable blue smoke. This is particularly the case during overrun of the engine.

The present invention comprises a reciprocating internal combustion engine comprising an air input leading to the engine through an air filter, a turbocompressor, an air-meter throttle and inlet manifold, said engine including means for venting the engine crankcase to the air input after an air filter and via means for connecting the air input to the means for venting, valve means for controlling air flow through the means for venting and means for connecting to control the pressure in the crankcase below atomspheric pressure within certain limits, said valve means comprising a valve and the means for connecting.

To achieve this end in a preferred embodiment, the invention connects the crankcase with two sources of possible negative pressure such that the crankcase gases may flow to either, via these connections when appropriate. This causes a drop in crankcase pressure to the prespecified level controlled by a springboard diaphragm.

Two sources of possible negative pressure over the inlet manifold which fulfills this requirement, except when the throttle is subsequentially fully open, and any point in the breather system upstream of the turbocompressor but downstream of the air filter. This second possible source of negative pressure is effectively at atmospheric pressure at low engine speeds, but this pressure becomes more negative at higher engine speeds. It is possible to alternate the connections between the crankcase and prestated sources of negative pressure as appropriate, via valve means, such that the crankcase is in contact with the source of most negative pressure at any engine speed, the connection allowing gas flow such that the prespecified crankcase pressure can be substantially maintained.

The means for venting connects the crankcase of the engine to the air input to the engine just downstream of the air filter. The means for connecting comprises a duct connecting the air input at the inlet manifold to the means for venting. The valve means comprises a non-return valve in the connecting duct and a non-return valve in the means for venting. A further valve, advantageously a diaphragm valve, is disposed in a bypass around the non-return valve in the means for venting. This further valve is controlled by a sensor responsive to the pressure in the crankcase. When the pressure falls below a certain value the valve opens to permit air flow from the air input limiting crankcase depression. The non-return valves permit flow through the duct to the means for venting and through the means for venting when the pressure differentials are appropriate to that.

Figure 2:
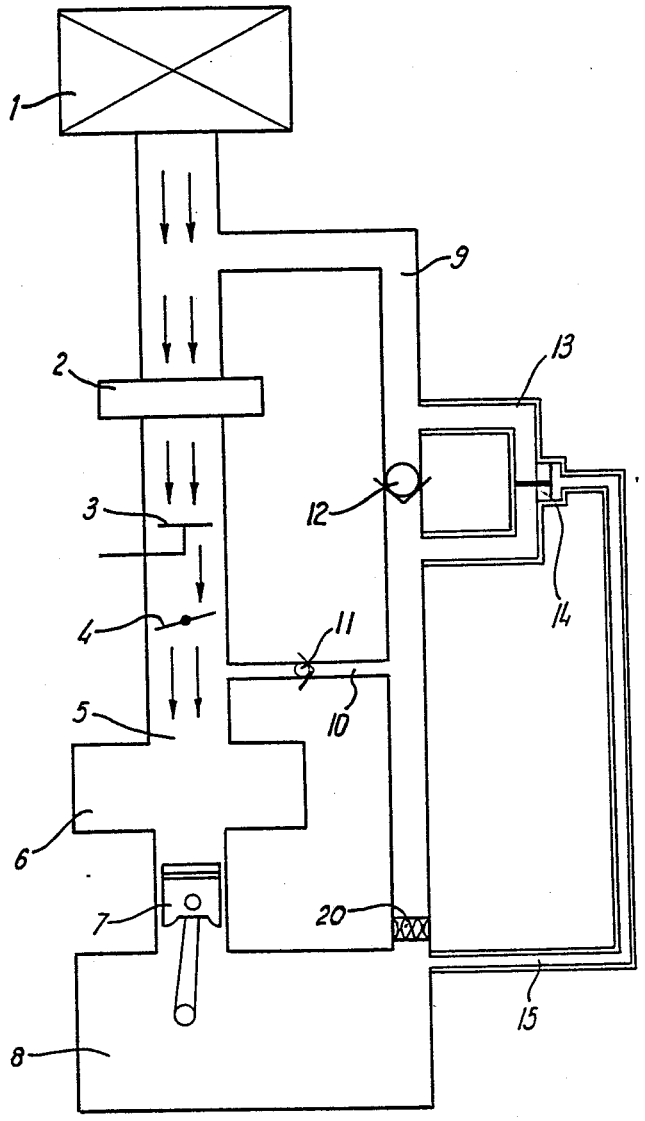
Figure 3:
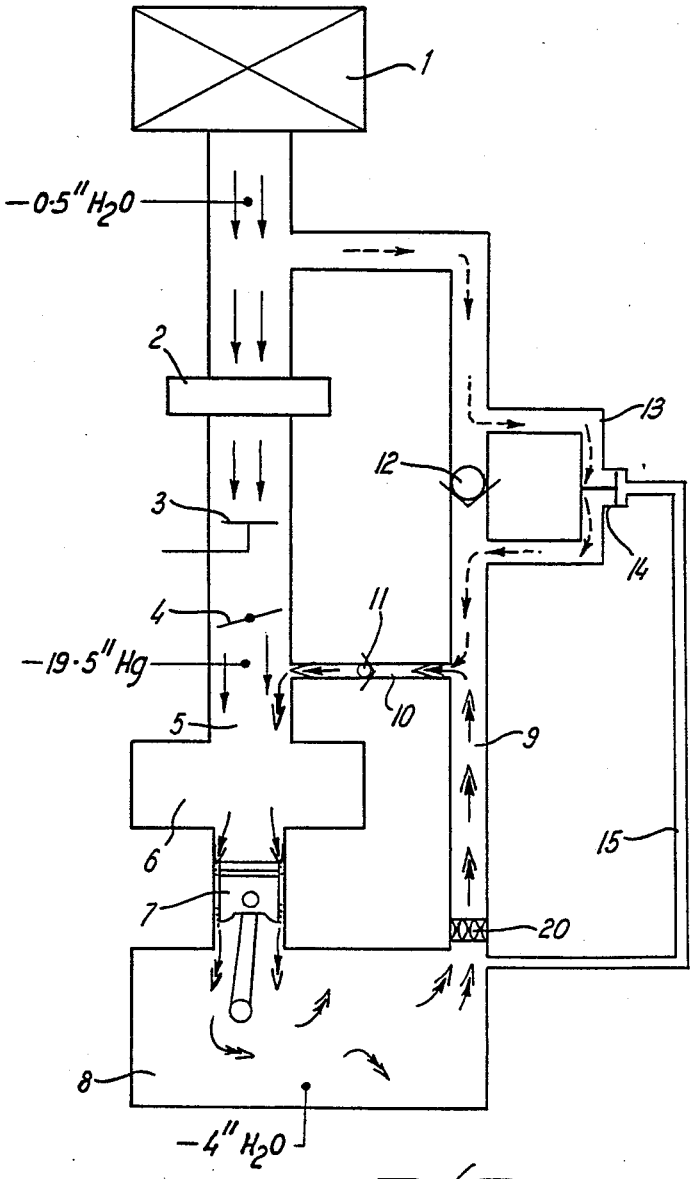
Figure 4:
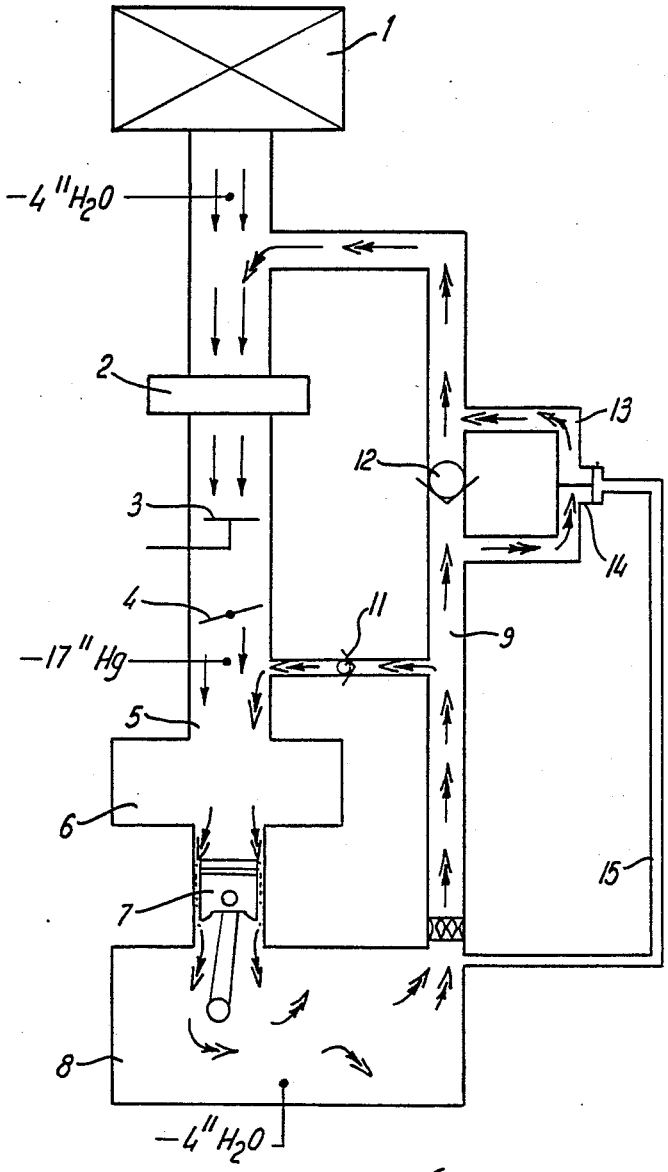
Figure 5:
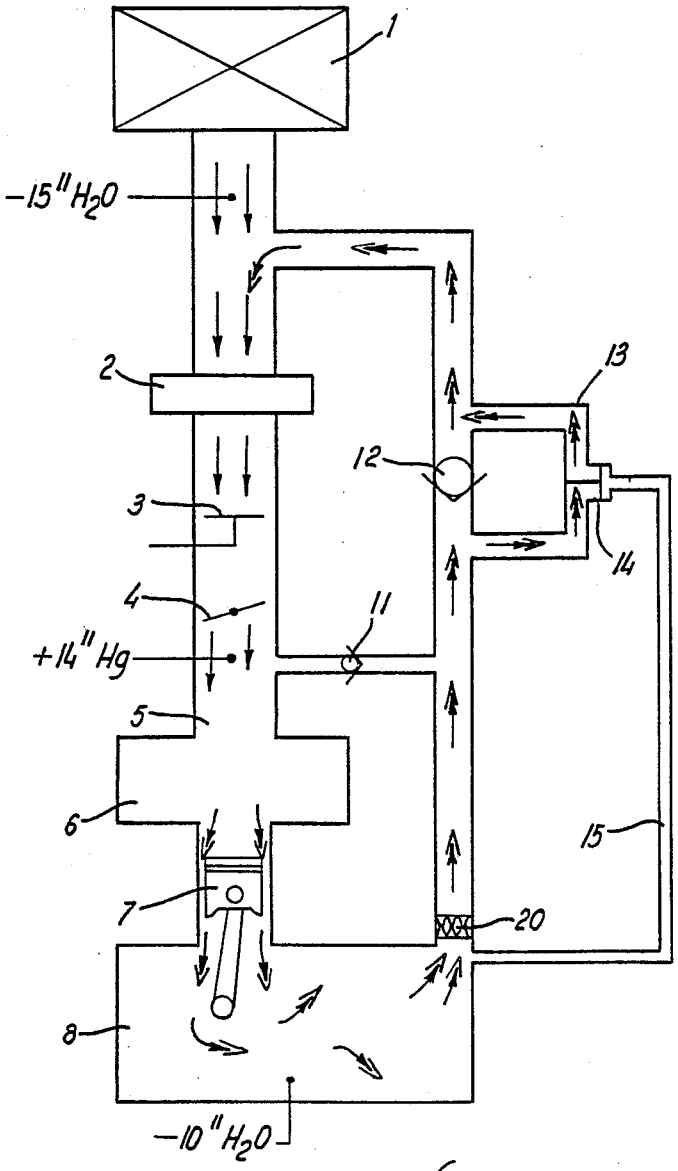

In order that the invention may be more clearly understood, one embodiment thereof will now be described by way of example with reference to the accompanying drawings, in which:

FIG. 1 shows an air flow diagram of an existing turbo-charged internal combustion engine, FIG. 2 shows an air-flow diagram of a turbo-charged internal combustion engine in accordance with the invention, and FIGS. 3, 4 and 5 respectively illustrate air-flow for the engine of FIG. 2 under idle intermediate load and high load conditions.

Referring to FIG. 1, in the breather system and induction system of the existing turbo-charged internal combustion engine, air flows through an air filter 1, the turbo compressor 2, past an air meter 3 and throttle 4, through the inlet manifold 5 into the combustion chambers 6 (one cylinder only shown) of the engine. About 0.4% of this flow blows by the pistons 7, the remainder exiting the engine through the exhaust. The blow by gas flows into the crankcase 8 and this can lead to an unacceptable pressure build up in the crankcase under certain conditions despite the provision of the bypass 9 which connects crankcase 8 to the point between the air filter 1 and compressor 2.

This build up may be prevented by the arrangement of FIG. 2. For this purpose, the inlet manifold is connected to the bypass 9 by a duct 10 in which a non-return valve 11 is disposed. A further non-return valve 12 is disposed in the bypass 9 and this valve is bypassed by a bypass 13, the flow through which is controlled by an adjustable spring loaded diaphragm valve 14 whose operation is controlled by the pressure in a pressure sensor line 15 leading to the crankcase 8. A flame trap 20 is also incorporated in the bypass 9.

The operation of the system will now be described with reference to FIGS. 3, 4 and 5. FIG. 3 shows the system under engine idle conditions when exemplary pressure values are $-0.5''H_2O$ just downstream of the air filter 1, and $-19.5''Hg$ at the inlet manifold. This large depression at the inlet manifold, which is caused at engine start up, sucks gas out of the crankcase. When the crankcase pressure reaches $-4''H_2O$, valve 14 opens premitting filtered air flow through bypasses 9 and 13, and duct 10 into the inlet manifold. Valve 12 is closed and valve 11 opens at that time. This air flow, which is indicated by dashed arrows, maintains the crankcase vacuum to that set by the springloaded diaphragm valve 14. The double headed arrows indicate the blow by gas flow which flows past the piston 7 into the crankcase and hence out of the crankcase 8 via flametrap 20 bypass 9 and duct 10 into the inlet manifold 5.

FIG. 4 shows the system under intermediate load conditions. Exemplary pressures are $-4''H_2O$ just downstream of the air filter 1, $-17''Hg$ at the inlet manifold 5 and $-4''H_2O$ in the crankcase. Valve 14 remains open, but valve 12 is unstable because the pressures on both sides are substantially equal. Some blowby gas flows to the inlet manifold via duct 10 and some flows to the point downstream of the air filter via valves 12 and 14.

FIG. 5 shows the system under high load conditions. Examplary pressures are $-15''H_2O$ just downstream of the air filter, $+14''Hg$ just downstream of the throttle 4, and $-10''H_2O$ in the crankcase 8. The inlet manifold 5 is now under boost conditions, valve 11 is closed and blowby gas, again indicated by double headed arrows flows via valves 12 and 13. The above described arrangement therefore prevents overpressure arising in the crankcase 8 over the normal operating range of the engine.

It will be appreciated that the above embodiment has been described by way of example only and that many variations are possible without departing from the scope of the invention. For example, the invention although described for a turbocharged engine would be equally applicable to a normally aspirated engine.

We claim;

1. A reciprocating internal combustion engine comprising an air input leading to the engine through an air filter, a turbocompressor, an air-meter, throttle and inlet manifold, said engine including means for venting the engine crankcase to the air input after the air filter, means for connecting the air input to the means for venting, valve means for controlling the air flow through the means for venting and the means for connecting to control the pressure in the crankcase below atmospheric pressure within certain limits, in response to crankcase depression, said valve means comprising a non-return valve in the means for connecting.

2. A reciprocating internal combustion engine as claimed in claim 1, in which the valve in the means for connecting comprises a non-return valve.

3. A reciprocating internal combustion engine as claimed in claim 1, in which the valve means for controlling air flow through the means for venting and the means for connecting comprises a second, non-return valve in the means for venting.

4. A reciprocating internal combustion engine as claimed in claim 1, in which the means for venting connects the crankcase of the engine to the air input to the engine just downstream of the air filter.

5. A reciprocating internal combustion engine as claimed in claim 1, in which the means for connecting comprises a duct connecting the air input at the inlet manifold to the means for venting.

6. A reciprocating internal combustion engine as claimed in claim 5, in which a further valve is disposed in a bypass around the non-return valve in the means for venting.

7. A reciprocating internal combustion engine as claimed in claim 6, in which the further valve is a diaphragm valve.

8. A reciprocating internal combustion engine as claimed in claim 6, in which control means are provided for the further valve for controlling the valve in response to the pressure in the crankcase such that when the pressure falls below a certain value the valve opens to permit air flow from the air input thus limiting crankcase depression.

9. A reciprocating internal combustion engine as claimed in claim 2 or 3, in which the valve means comprises a sensor.

* * * * *